United States Patent [19]

Junge et al.

[11] Patent Number: 4,462,536

[45] Date of Patent: Jul. 31, 1984

[54] CONTAINER MADE FROM A LAMINATE OF FIBER LAYERS

[75] Inventors: Norbert E. A. Junge, Troisdorf; Gerrit Kraan, Hennef, both of Fed. Rep. of Germany

[73] Assignee: Van Leer Verpackungen GmbH, Hamburg, Fed. Rep. of Germany

[21] Appl. No.: 459,193

[22] Filed: Jan. 19, 1983

[30] Foreign Application Priority Data

Jan. 20, 1982 [DE] Fed. Rep. of Germany ..... 3202033

[51] Int. Cl.[3] ..... B65D 3/18

[52] U.S. Cl. ..... 229/5.5; 229/4.5; 229/21

[58] Field of Search ..... 229/5.5, 4.5, 5.8, 21

[56] References Cited

U.S. PATENT DOCUMENTS

| | | | |
|---|---|---|---|
| 2,010,912 | 8/1935 | Brooks | 229/5.5 |
| 2,884,175 | 4/1959 | Wilson | 229/5.5 |
| 2,888,184 | 5/1959 | Hendry | 229/5.5 |
| 3,039,371 | 6/1962 | Leibreich | 229/5.5 |
| 3,229,887 | 1/1966 | Fehres | 229/5.5 |
| 3,434,651 | 3/1969 | Stec | 229/5.5 |
| 3,583,624 | 6/1971 | Peacock | 229/5.5 |

FOREIGN PATENT DOCUMENTS 989574 4/1965 United Kingdom .

*Primary Examiner*—William Price
*Assistant Examiner*—Gary E. Elkins
*Attorney, Agent, or Firm*—Brumbaugh, Graves, Donohue & Raymond

[57] ABSTRACT

The invention relates to a container made from a plurality of fiber layers, preferably from craft paper which fiber layers of wall (1) and bottom (2) are interconnected by a hot meltable adhesive. At the location of the connection incisions (14) are made in the wall which extend parallel to the axis of the container and have a cutting plane (14) extending at an acute angle ($\alpha$) with the respective tangential plane (167). At the inner side of the lips (13) obtained in this way an adhesive is applied in hot conditions at least at the folding line (8) and only thereafter the lips (13) are folded.

The container can have an overhead lid (4), the lid body (5) and disc (7) being made in a corresponding way.

4 Claims, 3 Drawing Figures

CONTAINER MADE FROM A LAMINATE OF FIBER LAYERS

BACKGROUND OF INVENTION

The invention relates to a container made from a plurality of fiber layers, in particular from a plurality of layers of craft paper, comprising a wall the layers of which being interconnected by means of an adhesive as well as a flat bottom from the same material, the connection between bottom and container wall having lips which are folded and adhered to the bottom disc, which container may have an overhead lid in which the connection between lid body and lid disc has been performed correspondingly.

A container of this type is known from Swiss patent specification No. 406,825. In this known container, the lips are formed by V-shaped cuttings out of the edge area of the container wall. The lips of the respective layers to be adhered are staggered such with respect to each other that a regular distribution of the lips is obtained in the area of connection with the bottom. This container is not satisfactory in practice, however, because the connections cannot withstand the occurring loads due to breakage in the folding area and due to the fact that the lips loosen.

In practice a parallel development proved to be satisfactory in which a container was made from fiber layers in which the connection between the container wall and the bottom, or of the lid edge and lid disc, respectively, is obtained by means of a metal ring which clamps the two parts to be interconnected. An example of such a container is found in British patent specification No. 989,574. While the connection with metal rings is reliable, however, it increases the plies.

A purpose of the invention is to provide a container of simple and reliable construction without the necessity of using a metal ring.

SUMMARY OF THE INVENTION

According to the invention this purpose is achieved in that the layers of wall, bottom and eventually lid body and lid disc are adhered upon each other by means of a hot meltable adhesive, that the incisions in the edge of the container wall or the edge of the lid body respectively for making the lips are formed by incisions extending parallel to the axis of the container wall or lid body respectively. The planes of the incisions are at an acute angle with the respective tangential plane to the wall or lid body, respectively, and the lips of the lid body are adhered to the lid disc by making use of a hot meltable adhesive applied in hot condition upon the lips prior to their complete folding.

The hot meltable adhesive has the so far unknown effect that the adhesive applied in hot condition for the adhesion of the lips with the bottom disc does heat the folding place of the body laminate to an extent such that the hot meltable adhesive present between the layers of the body laminate is softened due to which the fiber layer structure becomes flexible. Due to the application of the hot meltable adhesive a tempory movability of the fiber layers with respect to each other is obtained as a result of which the lips can be folded free of any tension. As a result no breaking takes place any more at the folding place and the lips no longer tend to spring back as was the case with the adhesive used before.

Accordingly the invention offers a container the construction of which is simple and which is reliable in use.

It is observed in this connection that in manufacturing container parts, such as wall, lid and bottom, to be used for containers in which the connection is obtained by means of said metal ring, one did already make use for some time of a hot meltable adhesive to interconnect the fiber layers. Herewith, however, the problem of the folding of lips and the adhesion of said lips with the bottom disc does not occur.

To obtain a reliable construction it is part of the invention as well that the lips are obtained by incisions which are made in the edge of the container wall or lid body edge respectively in a direction parallel to the axis of the container and with the planes of the incisions at an acute angle with the respective tangential plane of the wall or lid body respectively. In this way one obtains that upon folding of the lips said lips shift one over the other in an overlapping manner with equal distribution of the applied adhesive. The more acute the angle the more equally the lips will shift one over the other and lie against each other. In this way a kind of flange is formed in a tension free manner. Said linear incisions are considerably more easy to manufacture than the known triangular cutings. They have moreover the advantage that no cut particles are formed which have to be removed. Due to said form of the lips and due to the tension free folding a connection is obtained between container wall and bottom disc and between lid body and lid disc respectively the strength of which is considerably larger than with the known connection of lips and due to this a manufacturing of containers became possible which in respect of reliability and strength can be compared with containers with metal rings with the difference, however, that the container according to the invention can be manufactured cheaper.

The invention also relates to a method of manufacturing a container or a lid respectively of the invention and said method is characterized in that the hot meltable adhesive is applied in hot condition at least in the area of the folding line of the lips at the inner side of said lips and that said lips are folded into the plane of the bottom disc of lid disc respectively only after the hot adhesive has heated the material of the wall. Due to the fact that the adhesive for the connection is applied immediately at the folding line the heating and accordingly softening of the adhesive between the fiber layers is obtained at the critical folding place.

BRIEF DESCRIPTION OF THE DRAWINGS

The invention now will be further described with reference to the drawings, in which.

DETAILED DESCRIPTION OF THE DRAWINGS

Figure 1:
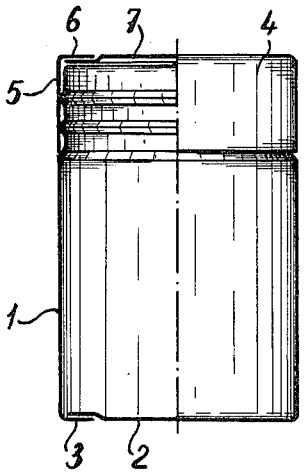
FIG. 1 is a partial side view partially in cross section showing a container constructed in accordance with the present invention.

The container shown in FIG. 1 comprises a cylindrical body 1 the wall of which is made by winding a plurality of layers of craft paper upon each other. Between the layers an adhesive is applied in a hot condition, and is capable of melting again when heated again.

The container has a bottom 2 connected with the container wall 1 in that the lower edge of the container wall 1 at 3 has been folded inwardly. To enable said folding it is known to provide V-shaped incisions. According to the invention, however, straight incisions are provided as will be explained more fully below.

A container has an overhead lid 4 in which the connection of the lid body 5 and the lid disc 7 has been obtained in the same way as explained above. The connection 6 is liquid tight.

The principle drawing of FIG. 1 holds true for the invention as well as for the prior art according to Swiss Pat. specification No. 406,825.

Figure 2:
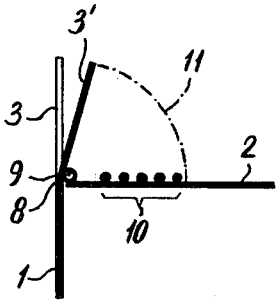
FIG. 2 shows in cross section the principle of application of the adhesive with the hinge effect obtained by the strip 9.

FIG. 2 shows the connection according to the invention between the bottom 2 and the container wall 1. The lips 3 are preformed out of the position indicated with thin lines so that they obtain the position indicated with a thick line 3' to define more clearly the folding line 8. This facilitates the positioning of the bottom 2.

Figure 3:
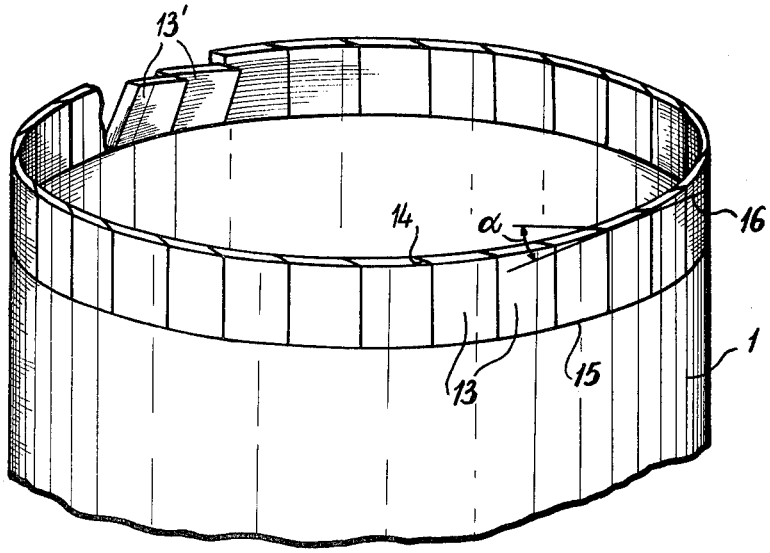
FIG. 3 illustrates the special form of incisions to obtain the interconnecting lips.

FIG. 3 shows a container wall 1 provided at one end with lips 13 formed by means of axial incisions 14 which extend up to the folding line 15 and each are at an acute angle with the tangential plane 16. The tangential plane 16 is parallel to the axis of the cylindrical container 1.

In this way, during folding of the lips the lips shift one upon the other without taking special measures, due to the fact that the inclined separating planes of the cutting planes slide upon each other.

At the folding place 9 at the inner side of the lips 13, and eventually also at the places 10, stripes of a hot meltable adhesive are applied in hot condition. The lips 13' are then folded as indicated by line 11 flat against the bottom 2, and pressed against it the bottom 2 long enough to allow the adhesive to harden.

The adhesive applied in hot condition in particular at the location of the folding line 8, ensures that the layers of the wall structure which are adhered upon each other by means of a similar adhesive are heated, and accordingly obtain more freedom to move with respect to each other, which permits easier folding and folding after folding, a connection is obtained which is free of tension.

When the lips slide upon each other the adhesive is equally distributed. In FIG. 3 two lips 13' are prefolded to show this sliding one upon the other. The more acute the angle $\alpha$ is the better this sliding can take place.

We claim:

1. In a container having an axis, at least one wall member, and a flat bottom member, said at least one wall member and said flat bottom member each comprising a plurality of fiber layers, and in particular a plurality of layers of kraft paper, said at least one wall member comprising a bottom portion bounded by a folding line, and lips formed in said bottom portion and adapted to be folded at said folding line and adhered to said flat bottom member to form a connection between said wall member and said bottom member, the improvement wherein a hot meltable adhesive is used for adhering the individual layers of said plurality of fiber layers together to form said at least one wall member, said lips and said flat bottom member, said hot meltable adhesive being applied to said lips in a hot condition prior to their complete folding against said flat bottom member, said lips being formed by linear incisions in said bottom portion extending parallel to said axis of said container up to said folding line, the planes of said incisions being at an acute angle with respect to a tangential plane of said at least one wall member, said tangential plane being parallel to said axis, whereby said hot meltable adhesive enables said individual layers of said lips to slide relative to each other when said lips are folded from said wall member against said bottom member, and wherein a portion of said lips overlap a portion of an adjacent lip once said lips are folded against and adhered to said bottom member.

2. A container according to claim 1, wherein said container is cylindrical, and said flat bottom member comprises a disc.

3. A container according to claim 1 or 2, and further comprising a lid member.

4. A container according to claim 3, wherein said lid member comprises a lid body having a folding line and lips formed in a portion of said lid body by linear incisions extending parallel to said axis and up to a folding line in said lid body, and a lid disc, said hot meltable adhesive being applied in a hot condition to said lips in said lid body prior to folding said lid body lips against said lid disc.

* * * * *